United States Patent [19]

Shamarokov et al.

[11] Patent Number: 4,489,788

[45] Date of Patent: Dec. 25, 1984

[54] STEAM GENERATOR

[76] Inventors: Alexandr S. Shamarokov, Profsojuznaya utitsa, 114; korpus 4, kv. 491; Alexei V. Kuzmin, prospekt Vernadskogo, 89, korpus 2, kv. 72; Vladimir P. Glebov, ulitsa admirala Makarova, 43, korpus 1, kv.76; Viktor F. Moskvichev, Soloviiny proezd, 18, kv. 229; Nadezhda A. Morozova, Korovinskoe shosse, 8, korpus 1, kv.50; Gennady A. Filippov, Molodogvardeiskaya ulitsa, 24, korpus 1, kv.34, all of Moscow; Gennady A. Tarankov, Podolsk, Gulevsky proezd, 8/5, kv.32; Boris I. Lukasevich, Podolsk, ulitsa Entuziastov, 1, kv.20, both of Moskovskaya oblast; Leonid M. Andreev, ulitsa Vorontsovskaya 30b, kv.101, Moscow; Viktor I. Grishakov, ulitsa Sverdlova, 54, kv.169, Podolsk Moskovskoi oblasti, all of U.S.S.R.

[21] Appl. No.: 462,445

[22] Filed: Jan. 31, 1983

[51] Int. Cl.[3] ..... F22B 1/04

[52] U.S. Cl. ..... 122/32; 122/34

[58] Field of Search ..... 122/32, 34

[56] References Cited

U.S. PATENT DOCUMENTS

| | | | |
|---|---|---|---|
| 3,227,142 | 1/1966 | Bell et al. | 122/34 |
| 3,376,858 | 4/1968 | Romanos | 122/32 |
| 3,557,760 | 1/1971 | Romanos | 122/32 |
| 3,751,886 | 8/1973 | Sokolowski | 122/34 X |
| 3,804,069 | 4/1974 | Bennett | 122/34 |

FOREIGN PATENT DOCUMENTS

| | | | |
|---|---|---|---|
| 968598 | 9/1964 | United Kingdom | 122/32 |

*Primary Examiner*—Henry C. Yuen

*Attorney, Agent, or Firm*—Fleit, Jacobson, Cohn & Price

[57] AESTRACT

In the casing of a steam generator there are provided a vertically extending manifold having a first chamber for admitting a heat carrier of the primary circuit and a second chamber for removing the heat carrier of the primary circuit, said chambers being isolated from one another, bundles of tubes for conveying the heat carrier of the primary circuit, said tubes defining a heat dispersing surface, a horizontally extending annular manifold for admitting feed water to the intertube space, a steam separator provided upstream the heat dispersing surface in the steam flow direction, the steam separator being secured to the casing, and a means for returning recirculation water back to the intertube space, said means being connected to the steam separator. The annular manifold extends concentrically with the vertically extending manifold and communicates with a pipe for supplying feed water. Inlet portions of the tubes of each bundle are radially fixed to the manifold and communicate with the first chamber and outlet portions of the tubes of each bundle are radially fixed to the manifold and communicate with the second chamber. A pipe for admitting feed water to the intertube space and a pipe for removing steam to a user are secured to the casing of the steam generator.

The heat dispersing tubes of each bundle extend in parallel with the vertical axis of the manifold. The inlet and outlet portions of the tubes in each bundle are bent and have their concave side facing toward the manifold.

3 Claims, 8 Drawing Figures

STEAM GENERATOR

The invention relates to the heat-exchange technology, and more specifically, to a steam generator.

The invention may be most successfully used in a steam generator employed at nuclear power plants with a water-moderated water-cooled power reacter. Steam is generated in the intertube space of the steam generator owing to the heat removal from a heat carrier of the primary circuit which flows through tubes defining the heat dispersing surface of the steam generator.

At the same time, the invention may also be used in the chemical and petrochemical industries where steam generated in steam generators is widely employed.

Frequent failures of tubes of the heat dispersing surface occur in steam generators generally used at nuclear power plants with a water-moderated water-cooled power reactor having horizontal flat tube plates, and in many instances this results in the loss of tightness of the primary circuit so that the radioactive water of the primary circuit gets mixed with the water of the secondary circuit thus causing a danger of discharges of radioactive water in the form of steam into the environment. One of the causes of such failures is the deposition of iron oxide sludge on the surface of the horizontal tube plates which results in a sharp increase in the concentration of chlorides and alkalis in the zone of fastening of the heat dispersing tubes to the tube plate causing corrosion of the tube material. This results in a rapid destruction of the tubes.

Another cause of damages is a vibratory wear of the tubes at points where they pass through holes in finger baffles installed at right angles to the tubes in the zone defining the economizer portion.

Vibration of the tubes are caused by the incoming flow of the secondary circuit water, namely feed water, moving around the tubes, as a result of break-away of vortexes at the root portion of the tube which deviate from the direction of water flow. The break-away of vortexes results in a re-distribution of pressures thus causing fluctuations of the magnitude and direction of pressure forces in the water flow at the front and rear parts of the tubes. The vibratory wear is pronounced owing to the presence of assembly clearances between the tubes and the finger baffles at points where the tubes pass through the baffles.

Other problems encountered in constructing steam generators include achieving better compactness, simpler manufacturing process, cutting-down manufacturing time and reducing metal requirements and cost of the steam generator.

High cost of steam generators is determined to a large extent by the use in many applications of expensive high-nickel alloys for the tubes of the heat dispersing surface such as incoloy and inconel. These alloys withstand better the chloride and alkaline corrosion and they are mainly used in steam generators with flat tube plates.

Known in the art is a vertical saturated steam generator or disclosed in U.S. Pat. No. 3,804,069.

The prior art steam generator comprises a casing having in its bottom part a flat tube plate and a vertical partition wall which divides the space between the tube plate and the bottom into a chamber for admitting a heat carrier of the primary circuit and a chamber for removing the heat carrier of the primary circuit. The casing of the steam generator accommodates a heat dispersing surface defined by vertically extending V-shaped tubes. The inlet portions of the tubes of each bundle are vertically fixed to the first chamber and the outlet portions of the tubes of each bundle are vertically fixed to the second chamber. A steam separator is provided with the upstream heat dispersing surface in the direction of steam flow. Means for returning recirculation water back to the intertube space is provided between the inner wall of the casing and the heat dispersing surface, said means comprising a shell which has its top portion secured to the steam separator. In addition, a vertical partition wall is provided in the casing which extends along the casing axis and is secured to the tube plate and to the shell. An economizer portion is provided in the space defined by the partition wall, a part of the tube plate and the shell, the economizer portion comprising horizontal finger baffles extending at right angles to the tubes of the heat dispersing surface which ensure the consecutive flow of feed water around the tubes of the heat dispersing surface. The feed water is supplied to the economizer portion through a pipe provided in the casing and connected to the shell. A pipe for removing steam to a user is secured to the casing of the steam generator upstream the steam separator.

As the tube plate extends horizontally, deposition of iron oxide sludge occurs on its top side. This results in a sharp increase in concentration of chlorides and alkalis and in a corrosion destruction of the tube plate. As a result, the reactor plant should be stopped for repairs of the steam generator tubes, thus causing a drop in the production of electric energy.

The provision of the economizer portion in the space defined by the partition wall, a part of the tube plate and the shell causes a decrease in the water flow velocity in the secondary circuit, i.e. a lower velocity of the feed water flowing around this part of the tube plate, which can only intensify the deposition of iron oxide sludge on the tube plate and accelerate the corrosion destruction of tubes at points where they are secured to the tube plate. The provision of the economizer portion by mounting horizontal finger baffles with holes for the passage of the tubes contributes to the vibratory wear (abrasion) of the tubes at points where they pass through the holes of the finger baffles by virtue of transverse flows of incoming feed water therearound. The vibratory wear becomes even stronger in view of manufacturing clearances imposed by the assembly between the tubes and finger baffles at points where the tubes pass therethrough. This may also result in a loss of tightness of the primary circuit and stoppage of the reactor plant for the installation of plugs into damaged tubes. This measure causes a reduction of the heat dispersing surface area of the steam generator, hence in a decrease in the output of the reactor plant and underproduction with loss of substantial quantity of electric energy.

Expensive high-nickel alloys such as incoloy or inconel are used to improve the resistance to chloride and alkaline corrosion at points where the tubes are secured to the tube plate as a result of deposition of iron oxide sludge. This results in an increase in the total cost of the steam generator.

Known in the art is a horizontal steam generator disclosed in USSR Inventor's Certificate No. 282,336.

This prior art steam generator has a horizontally extending casing which accommodates a vertically extending manifold for admitting a heat carrier of the primary circuit, a vertically extending manifold for removing the heat carrier of the primary circuit and a heat dispersing surface defined by U-shaped tubes extending in the horizontal plane. Spacer grids extending in a horizontal plane at right angles to the longitudinal axis of the tubes and defined by corrugated and flat strips are provided to avoid collisions of adjacent tubes which cause their abrasion. The spacer grids are equally spaced along the tubes. The inlet portions of the tubes are radially fixed to the vertically extending manifold for admitting the heat carrier of the primary circuit and the outlet portions of the tubes are radially fixed to the vertically extending manifold for removing the heat carrier of the primary circuit. The longitudinal axes of the vertically extending manifolds extend in parallel with one another, and the vertically extending manifolds are spaced from one another. A pipe for admitting feed water to the intertube space is secured to the casing. A steam separator is housed in the casing to extend upstream the heat dispersing surface in the steam flow direction. Pipes for removing steam to a user are secured to the casing.

Owing to the tubes of the heat dispersing surface being secured to the vertically extending manifolds in this prior art steam generator, there are provided conditions for eliminating deposition of iron oxide sludge on the outer surfaces of the manifolds at points where the tubes are secured thereto. Thus, tubes made of inexpensive stainless steels of the type containing 18% of chromium, 10% of nickel and 1% of titanium can be used for the manufacture of the steam generator so as to reduce the total cost of the steam generator. A long experience of operation of such steam generators showed that there was practically no case of stoppage of the steam generator caused by chloride or alkaline corrosion of the tubes of the heat dispersing surface when the tubes were made from the abovementioned steel. In addition, the spacing of the tubes eliminates their wear under the action of vibrations caused by transverse flow of incoming water or steam and water mixture from the secondary circuit around the tubes.

Though the horizontal arrangement of the steam generator casing has the abovementioned advantages, it results, however, in an inadequate structural design of the steam generator enclosed in a protective containment of the reactor plant. This results in a larger size and higher cost of the reactor plant. The prior art steam generator requires much metal for its construction owing to an increase in the casing wall thickness in the zone of fastening of the two vertically extending manifolds designed for admitting the heat carrier of the primary circuit and for removing the heat carrier of the primary circuit, respectively. The manifolds are not spaced apart from one another at a great distance.

Known in the art is still another generator disclosed in U.S. Pat. No. 3,376,858.

A spherical casing of the steam generator accommodates a vertically extending manifold having a chamber for admitting a heat carrier of the primary circuit and a chamber for removing the heat carrier of the primary circuit. The chambers are isolated from one another. A heat dispersing surface housed in the casing is defined by bundles of V-shaped tubes extending at right angles to the vertical axis of the manifold. The inlet portions of the tubes of each bundle are radially fixed to the manifold and communicate with the first chamber and the outlet portions of the tubes of each bundle are radially fixed to the manifold and communicate with the second chamber. Each bundle of tubes extends along a curved line, substantially along an involute in the cross-section of the steam generator.

A steam separator is provided upstream the heat dispersing surface in the steam flow direction, and a pipe for removing steam to a user is secured upstream the steam separator. Means for returning recirculation water back to the intertube space is provided in a space defined by the inner wall of the casing and the outer surface of the heat dispersing tubes, said means comprising a cylindrical shell connected to two series-connected conical shells. A manifold for admitting feed water to the intertube space is installed in the bottom part of the casing upstream the heat dispersing surface in the steam flow direction and communicates with a feed water supply pipe secured to the casing. The manifold extends in a horizontal plant concentrically with the vertically extending manifold. A manufacturing passage is defined in the space defined by the inner surface of the cylindrical shell, the outer surface of the vertically extending manifold and the heat dispersing surface of adjacent tube bundles. The passage is provided to facilitate the assembly or tube bundles extending along a curved line in the cross-section of the casing.

Owing to the tubes of the heat dispersing surface being secured to the chambers of the vertically extending manifold conditions are provided in the abovementioned steam generator for eliminating deposition of iron oxide sludge on the outer surface of the manifold at points where the tubes are secured thereto. As a result, the tubes of the heat dispersing surface may be manufactured of inexpensive stainless steels of the time containing 18% of chromium, 10% of nickel and 1% of titanium.

In case the unit capacity of the steam generator is to be increased, this construction of the heat dispersing surface results in a substantial increase in the diameter of the steam generator casing. This results in greater metal requirements for construction, increased cost and size of the steam generator casing.

An increase in the size and metal requirements for the construction of the steam generator also results from an inadequate filling of the intertube space of the steam generator with tubes as the distance between the tubes extending at right angles to the vertical axis of the manifold is equal to the distance between the tubes at points where they are secured to the manifold. This distance at the manifold should be relatively large and depends on the method of making holes in the manifold for securing the tubes, the manifold being, among other things, under a high pressure of the heat carrier of the primary circuit. All this results in a reduction (restriction) of the area of the heat dispersing surface per unit of the casing volume, hence, in increased metal requirements, high cost and large size of the steam generator.

The provision of the manufacturing passage which is not filled with tubes of the heat dispersing surface also results in an inadequate filling of the intertube space of the steam generator with tubes thus leading to a reduction of the area of the heat dispersing surface per unit of volume of the steam generator. This also results in an increase in the size, metal requirements and cost of the steam generator.

It is an object of the invention to reduce the size and weight of a steam generator while retaining the pre-set steam parameters at the outlet.

With this and other objects in view, the invention consists in that a steam generator having a casing accommodating a vertically extending manifold having a first chamber for admitting a heat carrier of the primary circuit and a second chamber for removing the heat carrier of the primary circuit, which are isolated from each other, bundles of tubes for conveying the heat carrier of the primary circuit which defines a heat dispersing surface, the inlet portions of the tubes of each bundle being radially fixed to the manifold and communicating with the first chamber and the outlet portions of the tubes of each bundle being radially fixed to the manifold and communicating with the second chamber, a horizontally extending annular manifold for admitting feed water to the intertube space which is installed concentrically with the vertically extending manifold and communicates with a pipe for feed water supply which is secured to the casing, a steam separator provided upstream the heat dispersing surface in the steam flow direction and secured to the casing, means for returning recirculation water back to the intertube space, which is connected to the steam separator, and a pipe for removing steam to a user secured to the casing, according to the invention, the heat dispersing tubes of each bundle extend in parallel with the vertical axis of the manifold, the inlet and outlet portions of the tubes of each bundle being bent and installed with their concave sides facing toward the manifold.

This construction of the steam generator results in a substantial reduction of its size and metal requirements for its manufacture owing to a decrease in the distance between the heat dispersing tubes in the bundle within the vertical section compared to the distance between the tubes within the horizontal part thereof since the distance between the tubes in the bundle within the vertical part thereof is determined by the size of spacer members and the distance between the tubes within the horizontal part thereof depends on the requirements imposed by the fastening of the tubes to the manifold.

The steam generator according to the invention provides for much power output per unit of the casing volume.

Owing to a preassembly of the heat dispersing tubes in the bundle with the control of quality of the assembly of the tube bundles the time for assembly of the steam generator is reduced.

The provision of the inlet and outlet portions of the tubes of each bundle which are bent with the concave side thereof facing toward the manifold makes it possible to accommodate such bundle of the heat dispersing tubes in a plane extending in parallel with the vertical axis of the manifold so that a larger number of the heat dispersing tubes may be provided per unit of the steam generator casing volume.

The tubes of each bundle preferably extend radially in the cross-section of the steam generator casing.

This construction of the steam generator makes it possible to facilitate the manufacture and reduce labour effort in the manufacture of tube bundles by reducing the number of bends of the tubes in the bundle and by making the bends with one and the same radius of curvature in one and the same plane.

A part of the downtake tubes of the bundle are preferably arranged in the space between adjacent bundles at an acute angle $\alpha$ to the radius extending through cross-sections of the riser and downtake portions of the tubes.

This results in a simpler manufacturing process and reduced labour effort in making the tube bundles owing to a smaller number of bends in the bundle and to identical radii of bend thus substantially reducing the cost of the steam generator.

The tubes of each bundle are preferably arranged along a curve, which is substantially an involute, in the cross-section of the steam generator casing.

This construction of the steam generator makes it possible to accommodate maximum possible number of tubes within the cross-section of its casing so as to make the steam generator more compact, reduce its size and metal requirements for its manufacture.

The tubes of each bundle are preferably arranged along a broken line in the cross-section of the casing with the curvature toward one side.

This construction of the steam generator facilitates the manufacture of tube bundles owing to the use of identical radii of bend.

The means for returning recirculation water back to the intertube space preferably comprises at least one box installed in the space defined by the inner wall of the casing, outer wall of the manifold and the heat dispersing surface of two adjacent bundles, the box communicating through an opening with a shell installed in the space defined by the inwardly facing surface of the heat dispersing tubes of the bundles and having its open end facing toward the manifold, the end of the box facing toward the separator being closed and the other end thereof being connected to the zone of the casing which extends downstream the heat dispersing surface.

This construction of the steam generator results in a substantial reduction of its size and metal requirements for its manufacture owing to the accommodation of the means for returning recirculation water between adjacent bundles of the heat dispersing tubes or, in other words, owing to the utilization of the manufacturing passage between the tube bundles or the space defined by the inner surface of the heat dispersing tubes, whereby the casing diameter can be reduced.

The steam generator is preferably provided with an annular manifold for supplying recirculation water to the intertube space, which extends horizontally and concentrically with the vertically extending manifold and which is secured to the casing and communicates with the interior of the box, and a horizontally extending partition wall which spans over the cross-section of the box and seals-off the space of the box provided for the recirculation water from the space of the box provided for the feed water.

This construction of the steam generator makes is possible to reduce both metal requirements for making tubes of the heat dispersing surface and total metal requirements and size of the steam generator.

This feature of the steam generator substantially resides in that the provision of the annular manifold and horizontally extending partition wall makes it possible to form an economizer portion in which the feed water is heated from a temperature at which it is admitted to the steam generator to the boiling point. The average temperature head between the heat carrier of the primary circuit and the feed water is thereby increased. This results in a reduction of the heat dispersing surface, hence in the reduction of the metal requirements for its manufacture and metal requirements for the manufacture of the steam generator and reduction of its size as a whole while retaining pre-set parameters at the outlet from the steam generator.

Other objects and advantages of the invention will become apparent from the following description of specific embodiments with reference to the accompanying drawings, in which:

FIG. 1 schematically shows a steam generator according to the invention in a vertical section;

Figure 8:
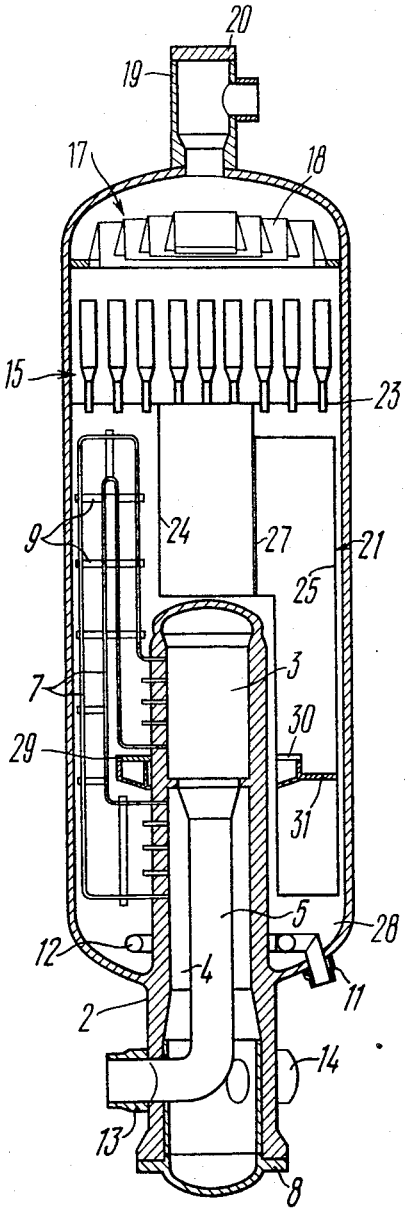

FIG. 8 schematically shows a steam generator according to the invention with an annular manifold for admitting recirculation water to the intertube space and with a horizontally extending partition wall; a vertical section.

Figure 1:
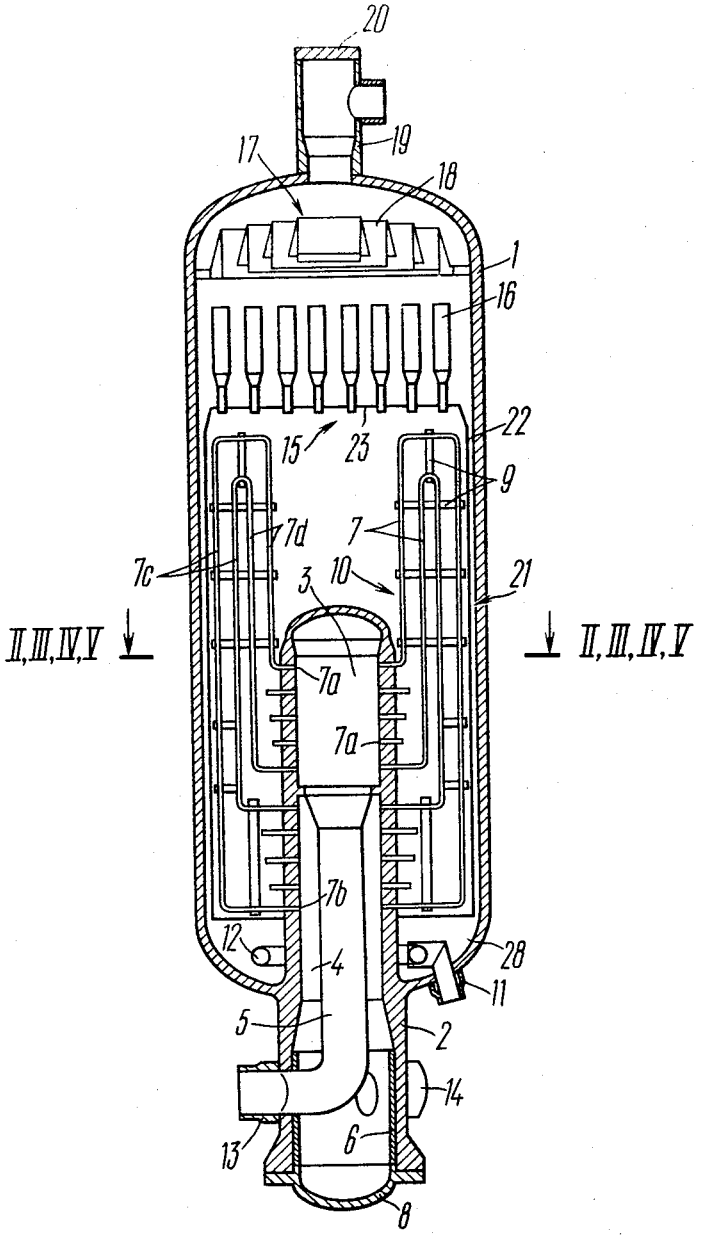
Figure 4:
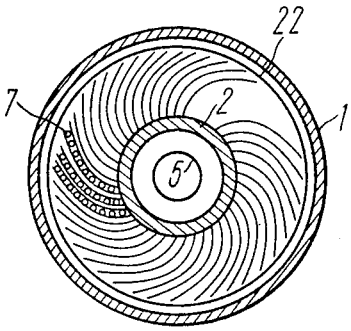
FIG. 4 is a sectional view taken along the line IV—IV in FIG. 1.

Referring now to FIG. 1, a casing 1 of a steam generator houses a vertically extending manifold 2 having a chamber 3 for admitting a heat carrier or coolant of the primary circuit and a chamber 4 for removing the heat carrier of the primary circuit.

The chamber 3 is isolated from the chamber 4 by means of a sleeve 5. The upper end of the sleeve 5 ensures the sealing owing to the difference in thermal expansion of the materials of the sleeve and manifold, and the lower end of the sleeve ensures the sealing owing to the difference in thermal expansion of the materials of the manifold and a shell 6 tightly secured to the sleeve 5.

For dismantling the sleeve 5 and for repairs of heat dispersing tubes 7 of tube bundles, there is provided a cover plate 8 secured to the manifold 2 by means of studs (not shown in the drawing). The tubes 7 are assembled into bundles by means of spacer members 9. The bundles of tubes define a heat dispersing and transfer surface 10 which is designed for transmitting the heat from the heat carrier of the primary circuit to the feed water so as to heat it to the boiling temperature and to achieve subsequent generation of steam. The heat dispersing tubes 7 of each bundle extend in parallel with the vertical axis of the manifold 2. Inlet portions 7*a* of the tubes 7 of each bundle are radially fixed to the manifold 2 and communicate with the first chamber 3, and outlet portions 7*b* of the tubes 7 of each bundle are radially fixed to the manifold 2 and communicate with the second chamber 4.

The inlet portions 7*a* and the outlet portions 7*b* of the tubes 7 of each bundle are bent and face with their concave side toward the manifold 2.

A pipe 11 for supplying feed water to the intertube space is secured to the casing 1 and communicates with an annular manifold 12 which is provided in the bottom part of the casing to extend horizontally and concentrically with the vertically extending manifold 2. The manifold 12 ensures a uniform distribution of feed water over the cross-section of the intertube space.

A pipe 13 secured to the manifold 2 is provided for admitting the heat carrier of the primary circuit to the chamber 3 and further to the tubes 7. For removing the heat carrier of the primary circuit from the pipes 7, there is provided a pipe 14 secured to the manifold 2 and communicating with the chamber 4.

A unit 15 of known per se centrifugal separators 16 for coarse separating steam from water is installed in the casing 1, and a unit 17 of louver separators 18 for fine separation of steam from water is provided upstream thereof in the steam flow direction (cf. N.G. Rossokhin, Steam Generating Units of Nuclear Power Plants (in Russian),Moscow, Atomizdat Publishing House, 1980, FIG. 13.2, p. 272). The water from the separators 16 and 18 is returned back to the intertube space and is referred to as recirculation water. The unit 15 of separators 16 and the unit 17 of separators 18 are installed upstream the heat dispersing surface 10 in the direction of steam flow.

For removing steam to a user, a pipe 19 is secured to the casing 1. The latter has an opening closed by a cover plate 20 which provides an access to the intertube space for inspection and repairs of various parts of the steam generator.

A means 21 is provided in the casing 1 for returning the recirculation water back to the intertube space. The means 21 comprises a shell 22 which is secured to the unit 15 of the separators and extends within the space between the inner wall of the casing 1 and the outer surface of bundles of the heat dispersing tubes 7.

The separators 16 are secured to an annular plate 23 which is fixed to the casing 1. The unit 17 of the separators 18 is secured to the casing 1.

Figure 2:
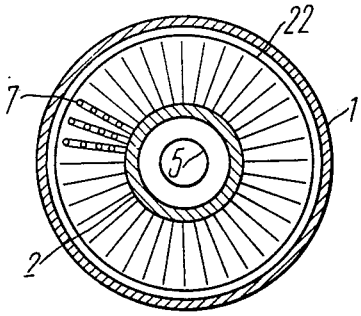
FIG. 2 is a sectional view taken along the line II—II in FIG. 1.

The tubes 7 of each bundle extend radially in the cross-section of the casing 1 (FIG. 2). This construction of the bundles of the tubes 7 facilitates the manufacture and reduces the labour effort in making the bundles owing to a smaller number of bends of the tubes in the bundle and to identical radii of bends in one and the same plane.

Figure 3:
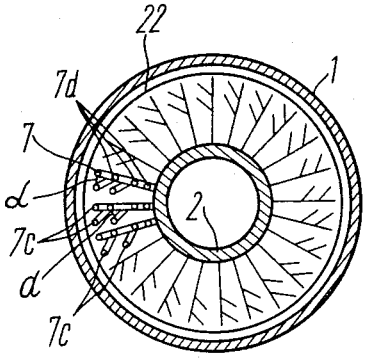
FIG. 3 is a sectional view taken along the line III—III in FIG. 1.

In order to increase the heat dispersing surface and hence, the output of the steam generator with the same size thereof, the longitudinal axes of downtake portions 7*c* (FIG. 3) of a part of the tubes 7 of the bundle are preferably accommodated in the space between adjacent bundles at an acute angle $\alpha$ to the radius extending through the cross-section of riser portions 7*d* and the downtake portions 7*c* of the tubes 7. The vertex of the angle $\alpha$ faces toward the manifold 2.

In order to reduce the metal requirements for the manufacture and the size of the steam generator while retaining its output parameters, the pipes 7 of each bundle (4) may be arranged in the cross-section of the casing 1 along a curve which is substantially an involute.

Figure 5:
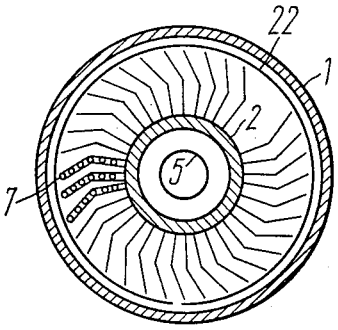
FIG. 5 is a sectional view taken along the line V—V in FIG. 1.

For reducing the metal requirements for the manufacture and the size of the steam generator and to facilitate the manufacture of the bundles of tubes 7 (FIG. 5), the tubes of each bundle are preferably arranged in the cross-section of the casing along a broken line with a curvature toward one side so as to make bends with identical radii of curvature.

Figure 6:
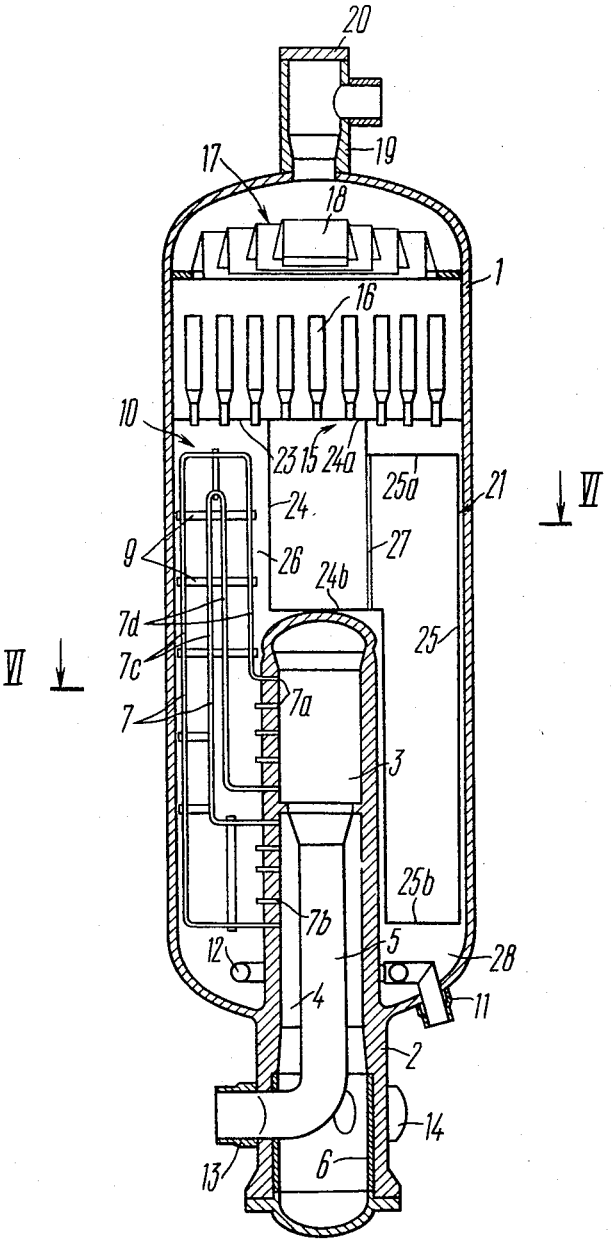
FIG. 6 is another embodiment of the steam generator according to the invention, a vertical section.

In the embodiment of a steam generator according to the invention shown in FIG. 6 a substantial reduction of its weight and size is achieved owing to the reduction of the casing diameter. The reduction of the casing diameter is ensured by accommodating the means 21 for returning back recirculation water back in the space between adjacent bundles of the heat dispersing tubes or in the manufacturing passage and in the space defined by the inwardly facing surface of the heat dispersing tubes.

Figure 7:
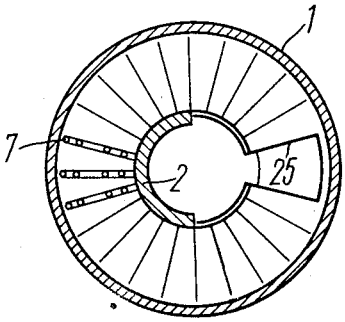
FIG. 7 is a sectional view taken along the line VII—VII in FIG. 6.

The means 21 comprises a shell 24 (FIG. 6) and a box 25 communicating with the interior of the shell. The shell 24 is accommodated in a space 26 defined by the inwardly facing surface of the heat dispersing tubes 7 of the bundles and has its open end 24*a* facing toward the unit 15 of the separators and its closed end 24*b* facing toward the manifold 2. In addition, the shell 24 has an opening 27 for communication with the box 25. The box 25 (FIG. 7) is accommodated in a space defined by the inner wall of the casing 1, the outer wall of the manifold 2 and the heat dispersing surface of two adjacent bundles of tubes 7. The end 25*a* (FIG. 6) of the box which faces toward the unit 15 of the separators 16 is closed and the other end 25*b* thereof communicates with a zone 28 of the casing 1 which is located downstream the heat dispersing surface 10.

In the embodiment of a steam generator according to the invention shown in FIG. 8 there is provided an annular manifold 29 for supplying recirculation water to the intertube space. The manifold 29 extends concentrically with the vertically extending manifold 2 and is secured to the casing 1. In addition, the manifold 29 communicates through an opening 30 with the interior of the box 25. The cross-section of the box 25 is spanned by a partition wall 31 which seals-off the interior of the box 25 designed for the recirculation water from the space of the casing 1 designed for the feed water.

We claim:

1. A steam generator comprising:

a casing;

an inner wall of said casing;

a vertically extending manifold located in said casing;

a first chamber in said vertically extending manifold for admitting a coolant;

a second chamber in said vertically extending manifold for removing coolant, said second chamber being isolated from said first chamber;

tubes for conveying the coolant including riser portions and downtake portions assembled into bundles and defining a heat transfer surface, said riser portions and said downtake portions extending in said casing in parallel with the vertical axis of said vertically extending manifold;

inlet portions of said tubes of each bundle being in fluid communication with the riser portions and extending radially from said vertically extending manifold and fixed to said vertically extending manifold and communicating with said first chamber, the inlet portions being bent and having their concave side facing toward said vertically extending manifold, outlet portions of said tubes of each bundle having one end in fluid communication with said downtake portions and the other end extending radially from said vertically extending manifold and fixed to said vertically extending manifold and communicating with said second chamber, said outlet portions being bent and having their concave side facing toward said vertically extending manifold;

a first annular manifold for uniformly distributing feed water over a cross-section of an intertube space, said annular manifold extending horizontally and concentrically with said vertically extending manifold;

a pipe for admitting feed water to the intertube space being secured to said casing and communicating with said first annular manifold;

a pipe for removing steam to a user secured to said casing;

a steam separator accommodated in said casing upstream from said heat transfer surface in the steam flow direction, said steam separator being secured to an annular plate, said annular plate being secured to the inner wall of said casing; and means for returning recirculation water back to the intertube space, said means connecting said steam separator with the intertube space;

wherein the longitudinal axis of each riser portion is spaced from said vertically extending manifold and extends from a point in the same radial direction from said vertically extending manifold as its respective inlet portion, and the longitudinal axis of each downtake portion is spaced from the vertically extending manifold and extends from a point in the same radial direction from said vertically extending manifold as its respective outlet portion, and the end of at least one outlet portion communicating with its respective downtake portion is bent at an acute angle with respect to the other end of the outlet portion fixed to said vertically extending manifold, wherein the vertex of the acute angle faces toward said vertically extending manifold.

2. A steam generator according to claim 1, further comprising:

a shell which comprises said means for returning recirculation water back to the intertube space, said shell having an open end facing toward said steam separator and a closed end facing toward said first annular manifold, said shell being accommodated in a space defined by an inwardly facing surface of said tubes;

at least one box of said means for returning recirculation water back to the intertube space;

an outer wall of said vertically extending manifold;

a space defined by said inner wall of said casing, said outer wall of said vertically extending manifold and the heat transfer surface of two adjacent bundles of said tubes, said space accommodating said at least one box; one end of said at least one box being closed on a side facing toward said steam separator;

a zone of said casing located downstream from said heat transfer surface, said zone communicating with the other end of said box; and an opening provided in said shell for communication with said at least one box.

3. A steam generator according to claim 2 further comprising:

a second annular manifold for supplying recirculation water to the intertube space, said second annular manifold extending horizontally in said casing and concentrically with said vertically extending manifold, said second annular manifold being secured to said casing and communicating with the interior of said at least one box; and a horizontal partition wall spanning the cross-section of said box and sealing-off the interior of said box designed for the recirculation water from the zone of the casing designed for the feed water.

* * * * *